United States Patent [19]

Kokubu et al.

[11] Patent Number: 4,931,690

[45] Date of Patent: Jun. 5, 1990

[54] COLOR PICTURE TUBE WITH AN ELECTRON SHIELD

[75] Inventors: Takemitsu Kokubu; Hiroshi Yoshioka, both of Mobara, Japan

[73] Assignee: Hitachi, Ltd., Tokyo, Japan

[21] Appl. No.: 157,789

[22] Filed: Feb. 19, 1988

[30] Foreign Application Priority Data

Mar. 20, 1987 [JP] Japan ..... 62-63789

[51] Int. Cl.[5] ..... H01J 29/07; H01J 29/84

[52] U.S. Cl. ..... 313/407; 313/402

[58] Field of Search ..... 313/407, 402

[56] References Cited

U.S. PATENT DOCUMENTS

| | | | |
|---|---|---|---|
| 3,855,493 | 12/1974 | Snook et al. | 313/402 |
| 4,367,430 | 1/1983 | Matsushita et al. | 313/402 X |
| 4,472,657 | 9/1984 | Sakurai et al. | 313/407 X |
| 4,517,487 | 5/1985 | Tamburrino | 313/407 |

FOREIGN PATENT DOCUMENTS

| | | | |
|---|---|---|---|
| 2324811 | 11/1973 | Fed. Rep. of Germany | 313/407 |
| 42056 | 3/1977 | Japan . | |
| 48464 | 4/1977 | Japan | 313/407 |
| 94160 | 6/1982 | Japan . | |
| 198825 | 11/1983 | Japan . | |
| 13824 | 2/1984 | Japan . | |
| 183845 | 8/1986 | Japan . | |

*Primary Examiner*—Palmer C. DeMeo

*Attorney, Agent, or Firm*—Antonelli, Terry, Stout & Kraus

[57] ABSTRACT

Disclosed is a color picture tube having an electron shield for shielding secondary electrons. The electron shield is formed by press-shaping a strip of a very low carbon steel containing not more than 0.02% by weight of carbon and has folds and/or corrugations formed at its marginal edge area.

12 Claims, 6 Drawing Sheets

COLOR PICTURE TUBE WITH AN ELECTRON SHIELD

BACKGROUND OF THE INVENTION

This invention relates to a shadow mask type color picture tube having an electron shield for shielding secondary electrons emitted from electron guns of the tube.

In a shadow mask type color picture tube, a shadow mask is fixedly positioned opposite to a phosphor screen by being supported by a support frame on an inner wall of a panel glass (an envelope) whose internal space is evacuated to a high degree of vacuum, and an electron shield for shielding secondary electrons is also fixed in position by the support frame along the outer peripheral edge of the shadow mask on the side of electron guns.

This electron shield is commonly produced by shaping an aluminum strip or foil having a thickness of 0.1 mm into the form by a press. The structure of such a color picture tube is disclosed in, for example, JP-U-52-42056 (Japanese Utility Model) filed in Japan by Hitachi, Ltd. on Sept. 19, 1975 and JP-A-58-198825 filed in Japan by Hitachi, Ltd. on May 14, 1982.

In some case, the function of such an electron shield is substituted by part of the support frame, that is, the electron shield is formed as an integral part of the support frame. In this case, a steel sheet having a thickness smaller than that usually used for making the conventional support frame is employed, and the support frame is formed by stamping or drawing the blank by means of a press. The support frame is disposed as close as possible to the inner wall surface of the panel glass, and the inner end of the support frame is extended as much as possible toward the interior of the panel glass so as to enhance the effect of secondary electron shielding.

Two forms of a color picture tube comprising such a light-weight support frame having an electron shield formed as its integral part as described above are disclosed in, for example, JP-B-59-1384 filed in Japan by Hitachi, Ltd. on Apr. 26, 1976 and JP-U-57-94160 filed in Japan by Hitachi, Ltd. on Dec. 1, 1980.

Generally, the surface of aluminum is oxidized by oxygen present in air and further hydrated by moisture present in air, so that the surface is turned into $Al_2O_3.3H_2O$. Therefore, when such a strip or foil of aluminum is used to make the electron shield, the decomposition $Al_2O_3.3H_2O \rightarrow Al_2O_3 + 3H_2O$ occurs when impinged by secondary electrons. Thus, $3H_2O$, that is, moisture is liberated in the color picture tube thereby degrading the emission characteristic of the cathode of the electron guns.

On the other hand, in the case of the support frame made of a steel sheet of smaller thickness to include the electron shield as its integral part, the mechanical strength is inevitably lowered to reduce the howling level.

Also, when the electron shield is entirely eliminated, lead (Pb) in vapor form tends to be liberated from a frit glass by the action of combustion gases during the step of conveying the envelope through a frit baking oven for welding the panel glass to a funnel glass by the frit glass. This liberation of lead vapor is undesirable in that not only discoloration of the frit glass occurs, but also leakage tends to occur at the weld or implosion of the tube tends to occur during the step of evacuating the tube.

SUMMARY OF THE INVENTION

It is an object of the present invention to provide a shadow mask type color picture tube in which its electron shield has sufficient mechanical strength while retaining the function of effectively shielding secondary electrons emitted from electron guns, in which undesirable discharge of gases in the tube can be substantially suppressed, and in which the initial rise rate of cathode emission can be maintained even after the end of a stability test.

In the present invention which attains the above object, the electron shield is made by shaping a strip of a very low carbon steel containing not more than 0.02% by weight of carbon into form by means of a press, and folds or corrugations are formed adjacent to the marginal edge of the electron shield.

DESCRIPTION OF THE PREFERRED EMBODIMENTS

Figure 1:
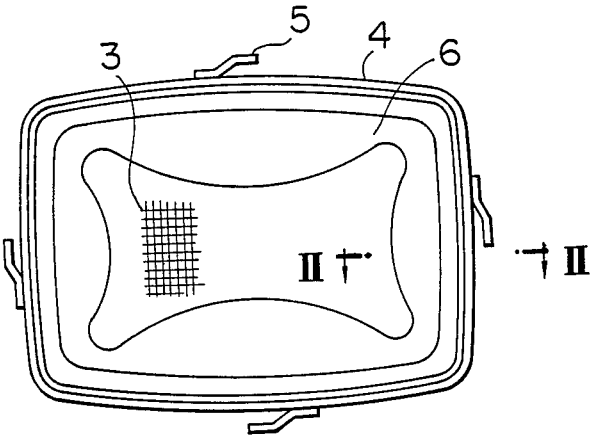
FIG. 1 is an inner plan view of a color picture tube.
Figure 2:
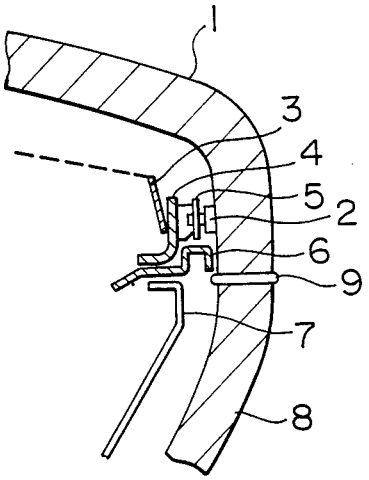
FIG. 2 is a sectional view taken along the line II—II in FIG. 1.

FIG. 1 is an inner plan view in a direction from the electron gun to the front screen of a shadow mask type color picture tube, and, in FIG. 1, a front glass plate disposed adjacent to a phosphor screen is removed to clearly show the internal structure of the tube. FIG. 2 is a sectional view taken along the line II—II in FIG. 1 to show the state of an electron shield mounted in the tube.

Referring to FIGS. 1 and 2, a plurality of panel pins 2 protrude from the inner wall of a panel glass 1 of a cathode-ray tube whose internal space is evacuated to a high degree of vacuum, and, along a phosphor screen of this panel glass 1, a shadow mask 3 (only part of which is shown) is welded to a support frame 4 which is in the form of a metal frame. The support frame 4 has two long sides and two short sides. A plurality of springs 5 are welded to the side walls of these four sides of the support frame 4, and are fitted on these panel pins 2 so as to fix the support frame 4 to the panel glass 1. Further, an electron shield 6 for shielding secondary electrons and an inner shield 7 for shielding the earth magnetism are also secured to the support frame 4 by the springs 5. These springs 5 act to compensate the thermal expansion of the shadow mask 3 due to the energy of electrons.

Figure 3:
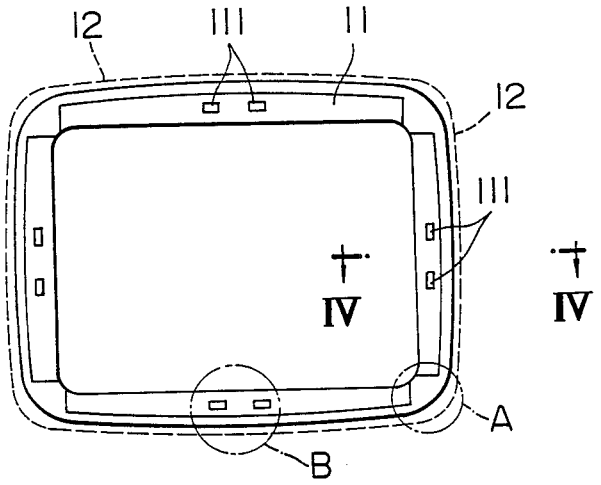
FIG. 3 is a schematic plan view of one form of the electron shield employed in the present invention.
Figure 4:
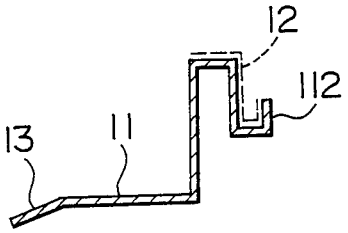
FIG. 4 is a sectional view taken along the line IV—IV in FIG. 3.

FIG. 3 is a schematic plan view of one form of the electron shield preferably employed in the present invention when viewed from the side of the electron guns as in the case of FIG. 1. This electron shield 11 is in the form of a generally rectangular one-piece frame. This electron shield 11 is formed into the rectangular one-piece frame structure by shaping a strip of a very low carbon steel containing not more than 0.02% by weight of carbon by means of a deep drawing press, and its sectional shape is as shown in FIG. 4. The carbon steel used for forming the electron shield 11 has, for example, a thickness of 50 μm, a tensile strength of 26 to 40 $Kg/mm^2$, an elongation larger than 28% and a Vickers hardness smaller than 125 μHV. The electron shield 11 is secured in a position as shown in FIG. 2 by engaging the inner shield 7 with the support frame 4 through holes 111 of the electron shield 11. The width and depth of deep drawing were 5 mm and 15 mm respectively.

Figure 5A:
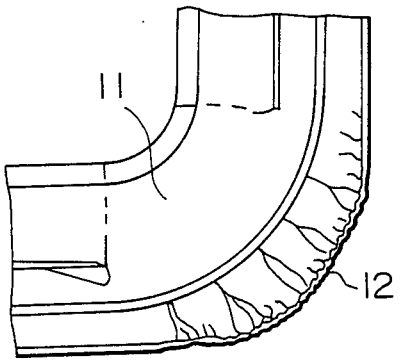
FIGS. 5A nd 5B show the states of corrugations formed at portions A and B respectively shown in FIG. 3.
Figure 5B:
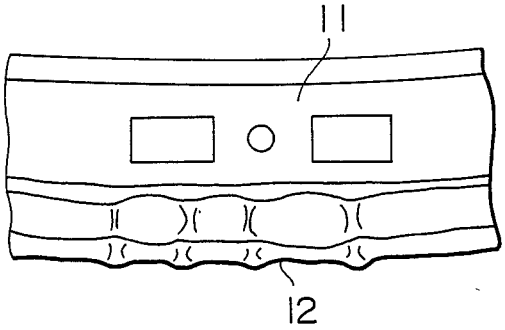

FIGS. 5A and 5B are enlarged views of portions A and B respectively of FIG. 3. The electron shield 11 has folds (or corrugations) 12 at its marginal edge or outer peripheral area. These folds 12 can be formed at the time of shaping the electron shield 11 itself by means of a deep-drawing press. By so shaping, the electron shield 11 is formed with a stable flat bent portion 13 for shielding secondary electrons and has a mechanical strength capable of sufficiently withstanding deformation, and the distance between its outer peripheral end face 112 and the inner wall surface of the panel glass 1 can be minimized.

That is, in order that combustion gases produced during the step of frit baking as described above may not flow through the area including the frit glass 9 used for welding the panel glass 1 to the funnel glass 8, the outer peripheral end face 112 of the electron shield 11 is preferably as close to the inner wall surface of the panel glass 1 as possible to such an extent that no gap is left therebetween. However, when the outer peripheral end face 112 of the electron shield 11 makes intimate contact with the inner wall surface of the panel glass 1, the electron shield 11 will damage the reflective metal film formed on the inner wall surface of the panel glass 1. Therefore, the outer peripheral end face 112 of the electron shield 11 should be as close to the inner wall surface of the panel glass 1 as possible without making any intimate contact therewith, and this object can be achieved by the utilization of the folds 12. The effect of shielding secondary electrons can also be improved. In FIGS. 3 and 4, the zone having those folds 12 is shown by the dotted lines.

Figure 6:
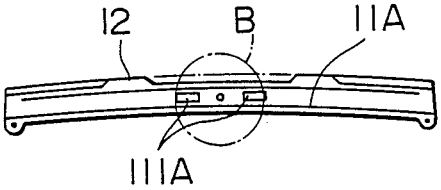
FIGS. 6 and 7 show schematically another form of the electron shield employed in the present invention.
Figure 7:
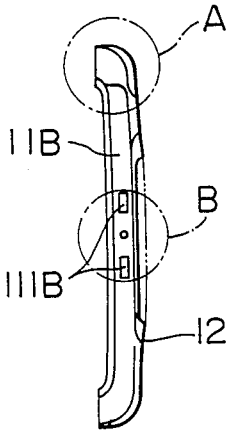

The above description has referred to an electron shield of one-piece structure. As a modification, the electron shield 11 may be provided by combining two long-side members as shown in FIG. 6 with two short-side members as shown in FIG. 7. More precisely, a pair of first electron shield members 11A having holes 111A are disposed along the respective long sides of the shadow mask 3, while a pair of second electron shield members 11B having holes 111B are disposed along the respective short sides of the shadow mask 3, and the inner shield 7 is engaged with the support frame 4 through the holes 111A and 111B to fix the electron shield members 11A and 11B to the support frame 4.

These electron shield members 11A and 11B are also formed by deep drawing a sheet of a very low carbon steel similar to that described above, and each of them has a sectional shape similar to that shown in FIG. 4. Folds or corrugations 12 similar to those shown in FIGS. 5A and 5B are formed at portions A and B of the marginal edge area of each of those electron shield members 11A and 11B to increase the mechanical strength and to ensure the dimensional stability.

Figure 8:
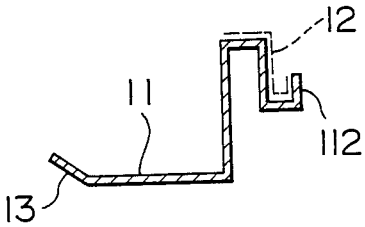
FIG. 8 is a schematic sectional view of another form of the electron shield employed in the present invention.

The bent flat portion 13 of the electron shield 11 intended to shield the beam of secondary electrons may be inclined away from the phosphor screen coated on the inner wall surface of the panel glass 1 as shown in FIG. 4 or may be inclined toward the phosphor screen as shown in FIG. 8.

Figure 9:
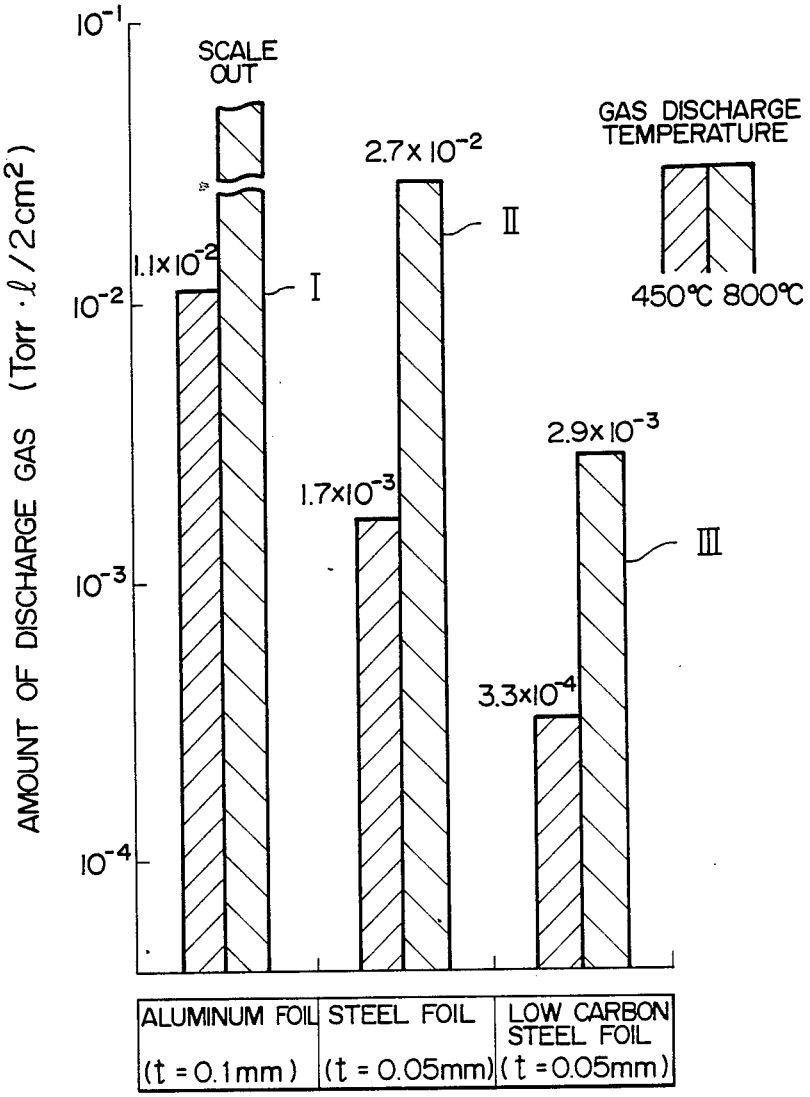
FIG. 9 is a graph showing the amounts of gases discharged during baking in a frit baking oven when different materials are used to form the electron shield.

FIG. 9 is a graph showing the results of comparison of the amounts of gases discharged from various kinds of materials used for forming the electron shield in a shadow mask type color picture tube, when heated at temperature of 450° C. and 800° C. for 5 min. The samples used in the test were a foil of aluminum (I), a foil of an ordinary carbon steel (II) whose carbon content is larger than 0.04% and a foil of a very low carbon steel (III) whose carbon content is not larger than 0.002% (the material of the electron shield in the present invention) and had a size of 10 mm×20 mm. Now, the amounts of gases discharged when the materials were heated at 450° C. for 5 min will be compared. It will be seen that, in the case of the aluminum foil (I), the amount of discharged gases is $1.1\times10^{-2}$ Torr·l/2 $cm^2$, while in the case of the ordinary steel foil (II), the amount of discharged gases is $1.7\times10^{-3}$ Torr.l/2 $cm^2$ which is about 1/6.5 of that of the aluminum foil (I). On the other hand, in the case of the very low carbon steel foil (III) used for forming the electron shield incorporated in the color picture tube of the present invention, the amount of discharged gases is $3.3\times10^{-4}$ Torr.l/$cm^2$ which is very small or only about 1/5 of that of the ordinary steel foil (II). The test results of measurement of the amounts of gases discharged from the materials when they were heated at 800° C. for 5 min show similar tendency.

Figure 10:
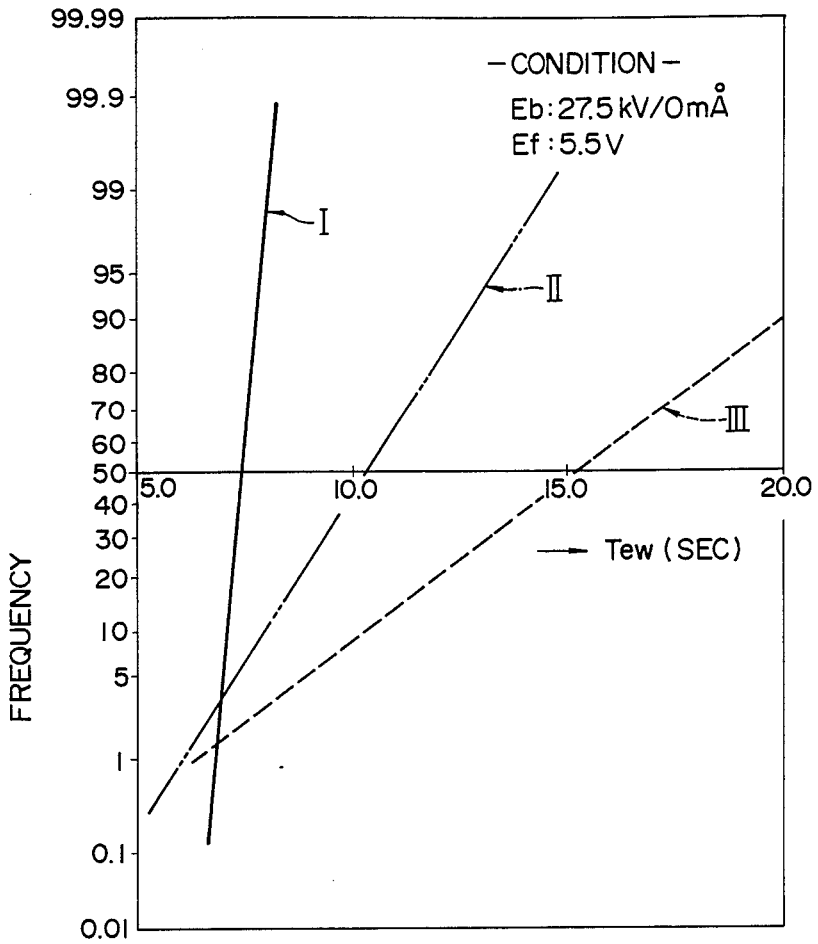
FIGS. 10 and 11 are graphs showing various rise rates of cathode emission when different materials are used to form the electron shield.
Figure 11:
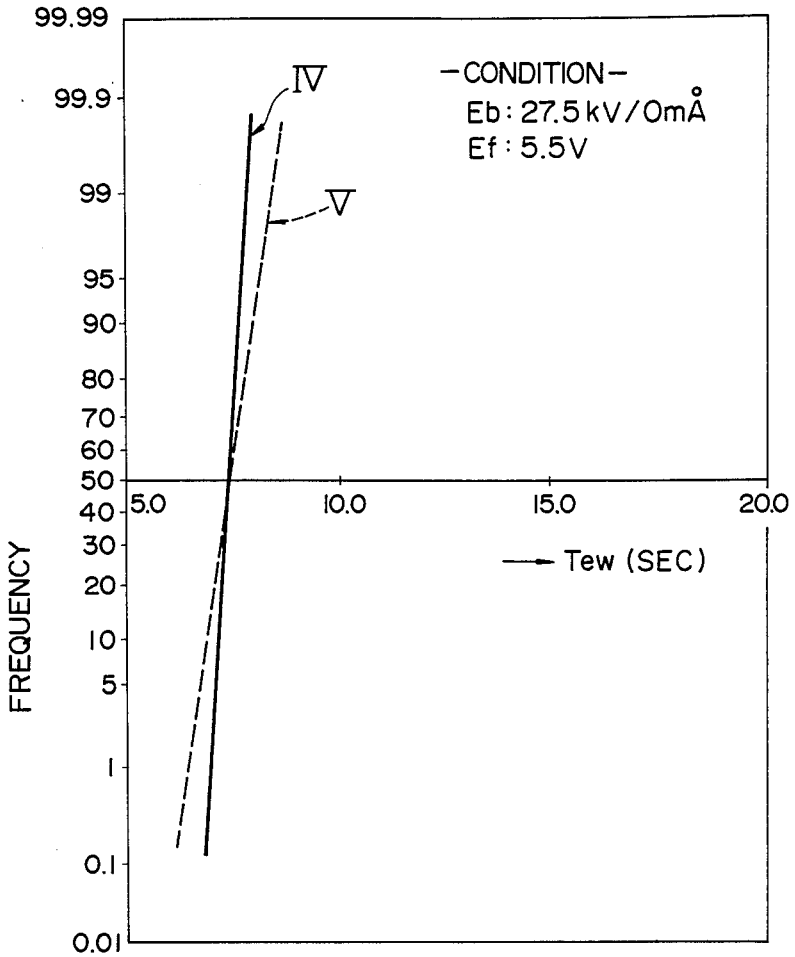

FIGS. 10 and 11 are graphs in which the rate of change Tew (sec) of the rate of rise of cathode emission before and after a stability test of a shadow mask type color picture tube using an electron shield of various materials is shown in terms of a frequency function. In FIG. 10, the solid line curve I represents the value of Tew measured before the stability test. The two-dot chain curve II represents the value of Tew measured after two hours from the start of the stability test, when the electron shield is in the form of a high carbon steel foil. It will be seen from the curve II that the mean value of Tew is now 10.4 (sec) which is about 30% degraded as compared to that measured before the test. Similarly, the dotted curve III represents the value of Tew measured after two hours from the start of the stability test when the electron shield is in the form of an aluminum foil. It will be seen that the mean value of Tew is now 15.2 (sec) which is about 50% degraded as compared to that measured before the test.

On the other hand, FIG. 11 shows how the value of Tew (sec) changes before and after the stability test when the electron shield formed of a very low carbon steel containing not more than 0.02% by weight of carbon and having a thickness of 0.05 mm is used in the color picture tube of the present invention. In FIG. 11, similarly the solid curve IV represents the value of Tew (sec) measured before the stability test, and the dotted curve V represents the value of Tew (sec) measured after two hours from the start of the stability test. It will be seen in each of the curves IV and V that the mean value is 7.4 (sec), and there is not any appreciable change between these curves IV and V. Therefore, the cathode emission characteristic can be stabilized more according to the present invention than the prior art.

The relation between the carbon content and the amount of discharged gases is described in detail in JP-A-61-183845 filed in Japan by Hitachi, Ltd. on Feb. 8, 1985.

It will be understood from the foregoing description of the present invention that the cathode emission characteristic of a shadow mask type color picture tube can be stabilized by employment of an electron shield formed by a strip of a very low carbon steel containing not more than 0.02% by weight of carbon. By forming folds or corrugations along the marginal edge area of the electron shield by shaping with a press, the electron shield can stably shield secondary electrons with its flat bent portion, has increased mechanical strength and does not damage the envelope portion sealed by a frit glass.

Therefore, unlike a color picture tube having no electron shield, panel baking for the purpose of discharging gases need not be carried out at a high temperature of 400° C. or more, and the number of manufacturing steps can be decreased together with the effect of energy saving.

We claim:

1. A color picture tube comprising:

a support frame fixed to an inner wall surface of an envelope of the color picture tube;

a shadow mask fixed to said support frame at a position opposite to a phosphor screen coated on a panel glass of said color picture tube; and an electron shield fixed to said support frame and disposed along an outer periphery of said shadow mask on the side remote from said phosphor screen, said electron shield being formed by press-shaping a strip of a very low carbon steel containing not more than 0.02% by weight of carbon and having folds or corrugations formed at its marginal edge area adjacent to and parallel with the inner wall surface of said envelope for enabling a distance between an outer peripheral end face of said electron shield and an inner wall surface of said panel glass to be minimized.

2. A color picture tube according to claim 1, wherein said electron shield is formed by a plurality of members.

3. A color picture tube according to claim 2, wherein said electron shield is constituted by a pair of first shield members disposed along the respective long sides of said shadow mask and a pair of second shield members disposed along the respective short sides of said shadow mask.

4. A color picture tube according to claim 1, wherein said electron shield is formed by a single strip.

5. A color picture tube according to claim 4, wherein said folds are formed at each of the corners of said electron shield.

6. A color picture tube comprising:

a support frame fixed to an inner wall surface of an envelope of the color picture tube;

a shadow mask means fixed to said support frame at a position opposite to a phosphor screen coated on a panel glass of said color picture tube;

electron shield means fixed to said support frame and disposed along an outer periphery of said shadow mask means on the side remote from said phosphor screen and substantially close to but without contacting an inner wall of said panel glass, said electron shield means including a strip of a very low carbon steel containing not more than 0.02% by weight of carbon press formed to have folds or corrugations at a marginal edge area thereof adjacent to and parallel with the inner wall surface of said envelope so that said electron shield means has a mechanical strength sufficient to withstand deformation and a distance between an outer peripheral end face of said electron shield means and the inner wall surface of said panel glass is enabled to be minimized.

7. A color picture tube according to claim 6, wherein said electron shield means is formed by a plurality of members.

8. A color picture tube according to claim 7, wherein said electron shield means is constituted by a pair of first shield members disposed along the respective long sides of said shadow mask and a pair of second shield members disposed along the respective short sides of said shadow mask.

9. A color picture tube according to claim 6, wherein said electron shield means is formed by a single strip.

10. A color picture tube according to claim 9, wherein said folds are formed at each of the corners of said electron shield means.

11. A color picture tube according to claim 6, wherein said folds or corrugations are formed along the entire perimeter of the marginal edge area of said electron shield means.

12. A color picture tube according to claim 1, wherein said folds or corrugations are formed along the entire perimeter of the marginal edge area of said electron shield.

* * * * *